US005210909A

United States Patent [19]

Toedtli

[11] Patent Number: 5,210,909

[45] Date of Patent: May 18, 1993

[54] PROCESS FOR OPTIMIZING YARN QUALITY

[75] Inventor: Sergej Toedtli, Wollerau, Switzerland

[73] Assignee: Siegfried Peyer AG, Wollerau, Switzerland

[21] Appl. No.: 784,420

[22] PCT Filed: Apr. 23, 1991

[86] PCT No.: PCT/CH91/00096

§ 371 Date: Dec. 20, 1991

§ 102(e) Date: Dec. 20, 1991

[87] PCT Pub. No.: WO91/16480

PCT Pub. Date: Oct. 31, 1991

[30] Foreign Application Priority Data

Apr. 25, 1990 [CH] Switzerland ..... 01393/90 2

[51] Int. Cl.[5] ..... D01G 13/00; D01G 37/00

[52] U.S. Cl. ..... 19/145.5; 19/80 R

[58] Field of Search ..... 19/80 R, 81, 145.5

[56] References Cited

U.S. PATENT DOCUMENTS

| | | | |
|---|---|---|---|
| 4,100,651 | 7/1978 | Wornall et al. | 19/145.5 |
| 4,587,691 | 5/1986 | Hösel | 19/145.5 X |
| 4,813,616 | 3/1989 | Hösel et al. | 19/145.5 X |
| 4,951,358 | 8/1990 | Binder et al. | 19/81 X |
| 5,025,533 | 6/1991 | Faas et al. | 19/80 R X |

FOREIGN PATENT DOCUMENTS

| | | | |
|---|---|---|---|
| 0362538 | 4/1989 | European Pat. Off. . | |
| 3335763 | 4/1985 | Fed. Rep. of Germany . | |
| 3051321 | 3/1991 | Japan | 19/145.5 |
| 481230 | 12/1969 | Switzerland . | |
| 0974196 | 11/1982 | U.S.S.R. | 19/80 R |

*Primary Examiner*—Clifford D. Crowder
*Assistant Examiner*—John J. Calvert
*Attorney, Agent, or Firm*—Walter C. Farley

[57] ABSTRACT

This method serves to optimize and maintain constant fiber-quality in automated mixing of bales having fibers of differing qualities. The bales (1*a*, . . . 1*k*, . . . 1*n*) are moved into the conveyance path (3) of a removal member (4) of a bale-removing device (2) and a fiber sample is automatically withdrawn in each case from the bale (1*k*) processed by the removal member (4) and is analyzed in measuring and control instrument (5). The analytical values so measured are continuously compared by a program in the measuring and control instrument (5) with nominal values and the comparison measurements so obtained in a continuous manner are used to maintain the mixing values by instructing the bale-removing device (2) to remove corresponding quantities from the particular bales (1*a*, . . . 1*k*, . . . 1*n*) evincing different qualities.

17 Claims, 1 Drawing Sheet

PROCESS FOR OPTIMIZING YARN QUALITY

FIELD OF THE INVENTION

The invention concerns a method for optimizing fiber quality and for maintaining the fiber quality constant in automated mixing with bales of textile fibers of different qualities.

BACKGROUND OF THE INVENTION

Automatic bale-removing machinery already is known (for instance the UNIFLOC type made by Rieter AG). However such machinery incurs the drawback that control is absent during the once-programmed removal and mixing procedure. Testing for a desired fiber quality can only be carried out after mixing (for instance up to 100 bales) has been completed and therefore no correction is possible during mixing.

SUMMARY OF THE INVENTION

The object of the invention is palliation. An object of the invention is to create a method for optimizing and keeping the fiber quality constant during automated mixing of bales having fibers of different qualities, the method allowing constant monitoring of the present mixing result and correction to one or more nominal values.

Essentially the advantages offered by the invention are "on-line" optimization thanks to the method of the invention when mixing in an automated manner bales having textile fibers of different qualities.

Bales of poor quality and bales of good quality therefore can be mixed in a controlled manner, on the basis of calculated and measured values, into a fiber material of average quality. The mixture average remains constant and does not vary with the instantaneous mean of all bales, so that constant fiber quality is achieved.

In the method of the invention, the quality of the fibers of a bale is measured not just once, as is the case for the procedures of the state of the art, but instead each bale is measured layer by layer, so that quality dispersion within a single bale can be better taken into account.

BRIEF DESCRIPTION OF THE DRAWINGS

The drawings show an illustrative implementation of the invention which at the same time elucidates the principle of operation, and is discussed below in further detail.

DESCRIPTION OF THE PREFERRED EMBODIMENT

Figure 1:
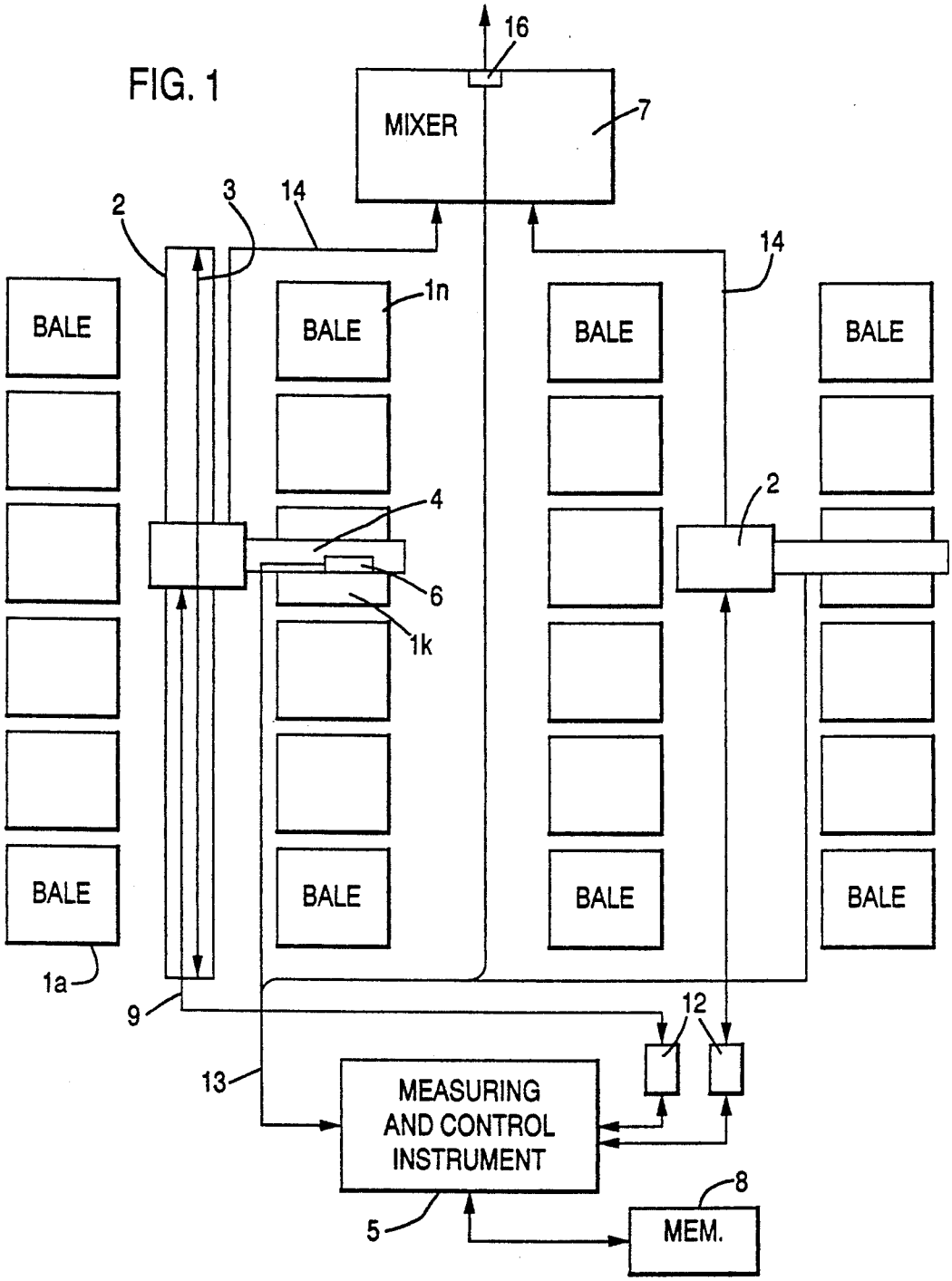
FIG. 1 is a schematic diagram of apparatus with which to carry out the method of the invention.

The schematically shown apparatus of the invention of FIG. 1 which serves to carry out the method of the invention essentially consists of a bale fiber-removing device 2 with a fiber-removing member 4, device and member 4 being mounted in displaceable manner for movement along a conveyance path 3. A sampling device 6 is mounted on the fiber-removing member 4 and linked by a fiber-sample transport system 13, for instance a mechanical conveyor or a pneumatic tube conveyor, with an automatic measuring and control instrumentation unit 5.

The fiber-removing member 4 is connected by a fiber-transport system 14 to a mixer 7. The bales 1*a*, . . . 1*k* . . . 1*n* having fiber to be mixed are mounted on both sides of the conveyance path 3 of the fiber-removing member 4 of the bale fiber-removing device 2.

The fiber-removing member 4 is displaced by the measuring and control instrument 5 from one bale to another in order to move the amounts and qualities of different fibers from the individual bales 1*a*, . . . 1*k*, . . . 1*n* as required for a given fiber quality and to move them to the mixer 7.

A fiber sample is taken from a particular bale 1*k* being processed in relation to removing the fibers, using for that purpose the sampling device 6 mounted on the removal member 4 and this fiber sample is moved by means of the fiber-sample conveyor system 13 to the automatic measuring and control instrument 5 wherein it is analyzed. The fiber sample to be analyzed preferably is withdrawn from the surface of the particular bale 1*k* being processed which faces the removal member 4.

Illustratively the textile analyzers used typically in the measuring and control unit 5 may be the fiber-measuring tracks (HVI) made by Spinlab Inc. or Motion Control Inc. In order to be applicable to the method of the invention, however, these analyzers must be entirely automated, so that sample preparation and sample transport both are fully automatic. The typical expert with conventional knowledge is able to match these instruments known in textile analysis to fully automated operation in the manner of the method of the invention, and accordingly such adaptation is not discussed further herein.

The quality parameters of the individual bales 1*a*, . . . 1*k*, . . . 1*n* can be ascertained in the first place conventionally prior to mixing and be fed into the memory 8 of the measuring and control unit 5. Alternatively, one sample each may be withdrawn in the course of a first removal of the removal member 4 from all bales 1*a*, . . . 1*k*, . . . 1*n* and be supplied to the measuring and control unit 5 to be analyzed therein, the data so ascertained then being stored in memory 8.

In order to run the apparatus, only the desired fiber quality (in the form of maxima and minima) of the fiber mixture to be prepared remains to be fed into the memory 8 of the measuring and control instrument 5.

The control of the removal member 4 takes place in such a way that the measuring and control instrument 5 computes a removal program based on the stored quality parameters of the individual bales 1*a*, . . . 1*k*, . . . 1*n* and the desired nominal values of the fiber mixture to be made using the suitable algorithms present in the memory 8, the removal program being implemented by suitably controlling the removal member 4 through the data line 9.

Such an algorithm illustratively may comprise the following steps:

(a) calculating the quantitative proportions of each bale in order to arrive at the required nominal values, (b) removing the fibers using the removal member 4, (c) withdrawing fiber samples using the sampling device 6, (d) checking to see that the fiber-sample values agree with those used in step (a); if not, correcting the values in memory 8 of the measuring and control unit 5 and begin again with step (a), (e) if another sampling device 16 is present at the output of mixer 7, withdrawing fiber samples at substantial intervals and comparing them with the nominal values; if agreement is lacking, the method of calculation of step (a) is corrected and step (a) is carried out again.

Preferably the removal member 4 is controlled by a digital interface 12 (typically RS232, V24, RS485 or LAN) transmitting the location and the particular height of the particular bales 1*a*, . . . 1*k*, . . . 1*n* and the pre-calculated quantity of fiber material to be removed.

The superiority of the method of the invention is that the quality parameters of the individual bales 1*a*, . . . 1*k*, . . . 1*n* fed into the memory 8 of the measuring and control instrument 5 can be continuously tracked and thereby qualitative differences between individual bales can be fully detected and be accounted for in the mixing algorithm.

Not only one, but several fiber parameters, preferably the length, thickness, degree of ripening and strength of individual fibers can be analyzed and monitored.

Figure 2:
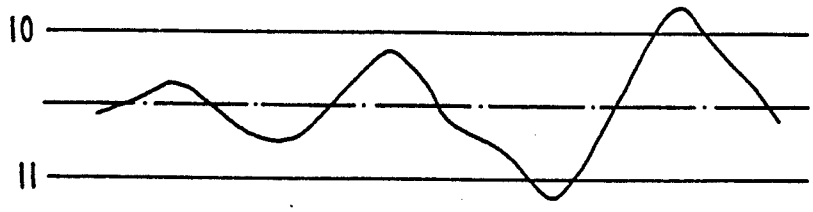
FIG. 2 is a graph of the instantaneous parameter value of the mixture obtained from the method of the invention.

The individual fiber parameters are optimized in such a way that, on the basis of the continuously ascertained fiber qualities and quantities evincing such quality, and by means of suitable algorithms, the measuring and control instrument 5 calculates the theoretical fiber quality of the mixture being continuously produced and compares it with pre-set nominal values (upper limit 10 and lower limit 11) and if required corrects the initially calculated removal program (FIG. 2).

The continuous comparison measurements of the fiber parameters may be displayed optically (FIG. 2) and/or they may be processed into acoustic signals which then allow manual control of the bale-removal device. However, these comparison measurements also may be used to control automatically the bale-removing device 2.

Moreover the measuring and control unit 5 can be used for monitoring and controlling several bale fiber-removing devices 2, and FIG. 2 illustratively shows two removal tracks.

I claim:

1. A method for automatically mixing fibers from bales of fibers of varying qualities and for optimizing and keeping constant the fiber quality in the mixed fibers comprising the steps of (a) moving a series of bales (1*a*, . . . 1*k*, . . . 1*n*) of different qualities of textile fibers into a conveyance path (3) of a fiber removal member (4) of a bale fiber-removal device (2), (b) selectively removing fibers from the bales with a removal member (4);

(c) automatically removing a fiber sample from each bale (1*k*) from which fibers have been removed by the removal member (4) and automatically analyzing the sample in a measuring and control instrument (5) to obtain analytical values representative of fiber quality, (d) continuously comparing the analytical values measured in (c) with preselected values by a program in the measuring and control instrument (5), (e) mixing the fibers removed from the selected bales; and (f) establishing and maintaining mixing values in accordance with the comparison measurements continuously carried out in step (d) by instructing the bale-removing device (2) to remove determined quantities of textile fiber material from selected bales (1*a*, . . . 1*k*, . . . 1*n*) of different qualities.

2. A method according to claim 1 wherein the step of removing includes removing the fiber sample from a surface of a selected bale (1*k*) being processed which faces the removal member (4).

3. A method according to claim 1 preceded by storing quality parameters of the individual bales (1*a*, . . . 1*k*, . . . 1*n*) in a memory (8) of the measuring and control instrument (5).

4. A method according to claim 1 and including ascertaining selected fiber properties in the analysis of the removed fiber samples including lengths and thicknesses of individual fibers.

5. A method according to claim 1 and including optically displaying results of the continuous comparison measurements carried out in step (d).

6. A method according to claim 5 and including using the comparison measurements of step (d) automatically to control the bale-removal device (2).

7. A method according to claim 1 and including controlling the removal member (4) with a digital interface (12) and providing to the interface locations and heights of individual bales (1*a*, . . . 1*k*, . . . 1*n*) and a predetermined quantity of fiber material to be removed.

8. A method according to claim 1 and including comparing the analytical values measured in step (c) with an upper limit (10) and a lower limit (11).

9. A method according to claim 1 wherein the step of mixing includes feeding with a fiber conveyance system (14) fiber material withdrawn by the removal member (4) from a bale (1*k*) to a mixer (7) wherein the material is mixed.

10. A method according to claim 9 and including withdrawing by means of a sampling device (16) mounted at the output of the mixer (7) fiber samples from the fiber mixture produced in the mixer (7) and feeding the samples to the measuring and control instrument (5) for analysis.

11. An apparatus for removing and mixing fibers from a plurality of bales of fibers of varying quality comprising means for conveying bales of fibers along a path;

a fiber removal means (2) with a removal member (4) displaceably mounted along said path (3) for removing batches of fibers from said bales, sampling means (6) mounted on said removal member (4) for taking fiber samples from said batches, and a measuring and control instrument (5) for receiving samples of fibers from said sampling device, analyzing said samples for quality and providing control signals to said removal means.

12. An apparatus according to claim 11 and including a fiber-sample conveyance system (13) comprising a mechanical conveyance belt between said sampling device (6) and said measuring and control instrument (5).

13. An apparatus according to claim 11 and further comprising a mixer (7) and a fiber-conveyance system (14) for delivering to said mixer fiber material by said removal member (4) from a bale (1*k*).

14. An apparatus according to claim 13 and further including a second fiber sampling device (16) at the output of said mixer (7).

15. A method according to claim 5 and including processing the measurements into acoustic signals allowing manual control of the bale-removing device (2).

16. A method according to claim 1 and including processing the measurements into acoustic signals allowing manual control of the bale-removing device (2).

17. An apparatus according to claim 11 and including a fiber-sample conveyance system (13) comprising a pneumatic tube conveyor between said sampling device (6) and said measuring and control instrument (5).

* * * * *